US007105788B2

(12) United States Patent
Hopkins

(10) Patent No.: US 7,105,788 B2
(45) **Date of Patent: *Sep. 12, 2006**

(54) MICROWAVE COOKING DEVICE WITH IMPROVED VENTING CONFIGURATION

(75) Inventor: Gary L. Hopkins, Scottsburg, IN (US)

(73) Assignee: Steamway Franchise Sales, Inc., Scottsburg, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/009,325

(22) Filed: Dec. 10, 2004

(65) Prior Publication Data

US 2005/0153025 A1 Jul. 14, 2005

Related U.S. Application Data

(63) Continuation of application No. 10/729,787, filed on Dec. 5, 2003, now Pat. No. 6,847,022.

(60) Provisional application No. 60/440,895, filed on Jan. 18, 2003.

(51) Int. Cl.
*H05B 6/80* (2006.01)

(52) U.S. Cl. ..... 219/725; 219/735

(58) Field of Classification Search ..... 219/725, 219/735, 730, 732; 220/367.1, 804, 373, 220/254.1; 99/472, 454, 451; 426/234, 426/107

See application file for complete search history.

(56) References Cited

U.S. PATENT DOCUMENTS

| | | | | |
|---|---|---|---|---|
| 2,633,284 | A | 3/1953 | Moffett et al. | |
| 3,835,281 | A | 9/1974 | Mannix | |
| 4,058,214 | A | 11/1977 | Mancuso | |
| 4,317,017 | A | 2/1982 | Bowen | |
| 4,529,089 | A | 7/1985 | Gasbarra et al. | |
| 4,560,850 | A | 12/1985 | Levendusky et al. | |
| 4,834,247 | A | 5/1989 | Oshima et al. | |
| 4,923,704 | A | 5/1990 | Levinson | |
| 5,039,001 | A * | 8/1991 | Kinigakis et al. | 229/120 |
| 5,310,981 | A | 5/1994 | Sarnoff et al. | |
| 5,369,034 | A | 11/1994 | Hargett et al. | |
| 5,587,192 | A | 12/1996 | Beizermann | |
| 5,750,967 | A | 5/1998 | Sprauer, Jr. | |
| 5,806,703 | A * | 9/1998 | Grandi | 220/203.15 |
| 6,035,769 | A | 3/2000 | Nomura et al. | |
| 6,380,524 | B1 | 4/2002 | Keller | |
| 6,847,022 | B1 * | 1/2005 | Hopkins, Sr. | 219/735 |
| 2001/0012530 | A1 | 8/2001 | Hiyoshi | |

* cited by examiner

*Primary Examiner*—Quang Van
(74) *Attorney, Agent, or Firm*—Carrithers Law Office PLLC; David W. Carrithers

(57) ABSTRACT

A microwave cooking device includes a container for holding a food product, a seal for sealing the container to enclose a substantially fixed volume therein, and a venting configuration. The venting configuration includes a steam guide defining a central vent and a pair of steam horns associated with and positioned on either side of the steam guide. The steam guide and associated steam horns weaken a portion of the seal at a predetermined location and are each in fluid communication with the volume enclosed within the container to allow movement of steam from the container into the steam guide and steam horns, such that, steam and pressure are preferentially directed towards the steam guide, causing pressure to be concentrated at the weakened portion of the seal and resulting in the seal being broken at a predetermined location.

13 Claims, 4 Drawing Sheets

MICROWAVE COOKING DEVICE WITH IMPROVED VENTING CONFIGURATION

CROSS REFERENCES TO RELATED APPLICATIONS

The present application is a continuation of U.S. patent application Ser. No. 10/729,787, filed on Dec. 5, 2003, now U.S. Pat. No. 6,847,022 which claims the benefit of U.S. Provisional Patent Application No. 60/440,895, filed on Jan. 18, 2003, which are hereby incorporated by reference in their entirety.

FIELD OF THE INVENTION

The present invention relates to the field of cooking devices, and, more particularly, to cooking devices for use in a microwave oven for cooking meats, vegetables, and other food products.

BACKGROUND OF THE INVENTION

Consumers often prefer to cook food in a microwave oven rather than conventional ovens because of the reduced cooking time required to heat foods in a microwave oven. Consumers also want to be provided with the opportunity to cook pre-packaged food products in the package in which they were purchased without the hassle of transferring the food from the package to a piece of cookware.

Unfortunately, foods cooked in a microwave oven tend to be tough and/or dry in texture and consistency, rather than tender and moist. When liquid is added to the food in an attempt to retain moisture, the food can become soggy and undesirable. In addition, microwave ovens do not evenly distribute heat to the product being cooked. This results in a cooked food product that may be very hot in one area, but cold in another area. Because of these problems, many people consider microwave cooking to be problematic and generally undesirable.

One method for improving the texture and consistency of food cooked in a microwave oven is to use steam generated by the heated food product to assist in cooking the food. Cooking with steam not only provides moisture for the food being cooked, but also results in more consistent heating throughout the food product.

Specifically, a device which uses the steam generated by the heated food product to assist in cooking the food takes advantage of the ideal gas law, a distillation of several kinetic theories including Boyle's Law and Gay-Lussac's Law. More specifically, such a device takes advantage of the proportional relationship between pressure and temperature when volume and number of gas molecules remain constant. This proportional relationship can be expressed as a mathematical equation, $(P_2/P_1)=(T_2/T_1)$, where $P_1$ is the initial pressure, $P_2$ is the final pressure, $T_1$ is the initial temperature, and $T_2$ is the final temperature.

Accordingly, any increase in pressure will result in a proportional increase in temperature that would not occur at ambient pressures. For example, if the pressure was to increases 1.2 fold (e.g., from 1 to 1.2 atmospheres), the temperature would also increase 1.2 fold (e.g., from 275 K to 330 K, which is an increase from 35° F. to 134° F.). Such a steam cooking method is described in commonly assigned U.S. Pat. No. 6,559,431, which is incorporated herein by this reference.

In order to steam cook by this method, the volume of the device must remain substantially constant; accordingly, the device must be at least partially sealed. When a sealed device is used to heat a food product contained therein, pressure rapidly builds as steam is generated from the heated food product. As heating continues, this pressure will continue to escalate until the device's seal is broken, thereby relieving the pressure.

This relief often comes in the form of an explosion forcing the seal to open and resulting in food being ejected from the device. Not only does such an explosion create a mess, but it also undermines the attempt to use steam to cook the food product because the explosion causes a rapid release of the collected steam from the no longer sealed cooking environment.

The release of pressure can be controlled by including vents within the seal of the device, resulting in weakened portions in the seal. When the sealed cooking environment attains a pressure creating a risk of explosion, the weakened portions in the seal allow for a controlled pressure release at the vents. In addition to providing a point for the release of pressure and steam, the opening formed at the weakened portion in the seal creates one or more tabs which may be grasped and pulled, breaking the remainder of the seal such that consumption of the food product may occur. Such a venting configuration is described in commonly assigned U.S. Pat. No. 6,559,431 which has been incorporated herein by reference.

Although this type of venting configuration allows some degree of control over the location that the pressure release will occur, any one or more of the weakened portions in the seal may allow venting during a particular heating session. For example, during one heating session, two vents in a first portion of the seal may allow for pressure release while the seal remains intact at the other vents, while during another heating session, a single vent in a second portion of the seal may allow for pressure release while the seal remains intact at the other vents. Thus, the exact location and number of points at which the seal will break is difficult, if not impossible, to predict.

Furthermore, the surface area over which the seal is broken dictates how rapidly the pressure within the cooking environment will drop, thereby effecting the texture and consistency of the prepared food. Also effecting the texture and consistency of the prepared food is the location at which the seal is broken, which dictates the path of the steam being used to cook the food. Finally, since the opening formed in the seal when venting occurs creates one or more tabs which may be grasped and pulled to open the container for consumption of the food product, the location at which the seal is broken effects the convenience with which the device may be used.

Therefore, it would be desirable to provide a microwave cooking device for steam cooking which allows for improved venting control.

SUMMARY OF THE INVENTION

The present invention is a microwave cooking device with an improved venting configuration. The device generally includes a container for holding a food product, a seal for sealing the container such that a substantially fixed volume is enclosed therein, and a venting configuration for controlled venting of the device.

The container of the device may take any size or shape capable of fitting into a microwave oven. The container includes at least one compartment for holding food product, the compartment having a bottom surface with a side wall extending therefrom and terminating at a upper surface defining the top of the device. To facilitate steam cooking of the food product, the compartment is sealed to enclose a substantially fixed volume and is equipped with a venting configuration. The seal of the device may be created between two portions of the container itself or between the container and a separate covering. If a separate covering is used, the covering may be, for example, a heat-seal film, food-grade-adhesive-seal film, a snap-on lid, or a vacuum-sealed covering.

The venting configuration of the device is designed to allow for controlled venting, specifically urging the seal to be broken at a predetermined location adjacent the venting configuration. Each venting configuration thus comprises at least one steam guide and an associated pair of steam horns. The steam guide defines a substantially V-shaped central vent in the seal, having the tip of the "V" ending before the outer edge of the seal. Because the surface area of the seal is reduced at the tip of the steam guide, there exists a weakened portion in the seal at that location. The steam horns are positioned on either side of the steam guide, each steam horn defining a side vent in the seal, ending before the outer edge of the seal. Specifically, it is preferred that each steam horn have a curved shape that is angled toward the tip of the steam guide. Because the surface area of the seal is further reduced by the incorporation of steam horns, the seal is further weakened at this location.

Because the volume of each compartment remains substantially fixed until venting occurs, as steam is generated the food product during heating, pressure builds within the compartment. As the pressure continues to build, the steam guide directs the steam and pressure to its tip. Likewise, the steam horns, which are angled inward toward the tip of the steam guide, direct the steam and pressure toward the tip of the steam guide. Thus, the pressure is heavily concentrated at the weakened portion of the seal, causing the seal to preferentially break adjacent the tip of the steam guide.

In a multi-compartment microwave cooking device made in accordance with the present invention, each venting configuration may be customized such that the pressure achieved in the associated compartment is optimal for the type of food product contained therein. The venting configurations can be customized in several different ways. For example, the angle of the pair of the steam horns may be varied such that they terminate at points of various distances from the tip of the associated steam guide, thus allowing the concentration of pressure to be directed over various widths along the seal, which allows the size of the break in the seal to be controlled. Likewise, the number of steam guides or steam horns in a particular compartment could be altered to vary the width of pressure concentration. In this manner, each compartment in a single device can achieve different pressures.

DETAILED DESCRIPTION OF THE INVENTION

Figure 1:
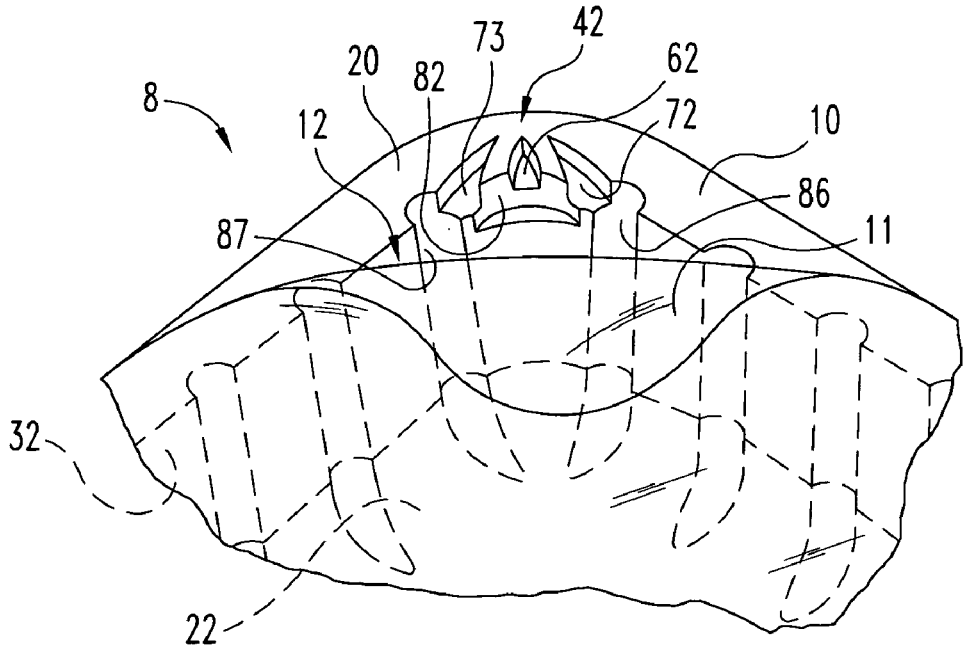
FIG. 1 is an enlarged partial perspective view of a microwave cooking device made in accordance with the present invention, illustrating a preferred venting configuration and showing a portion of the covering pealed away from the container.
Figure 2:
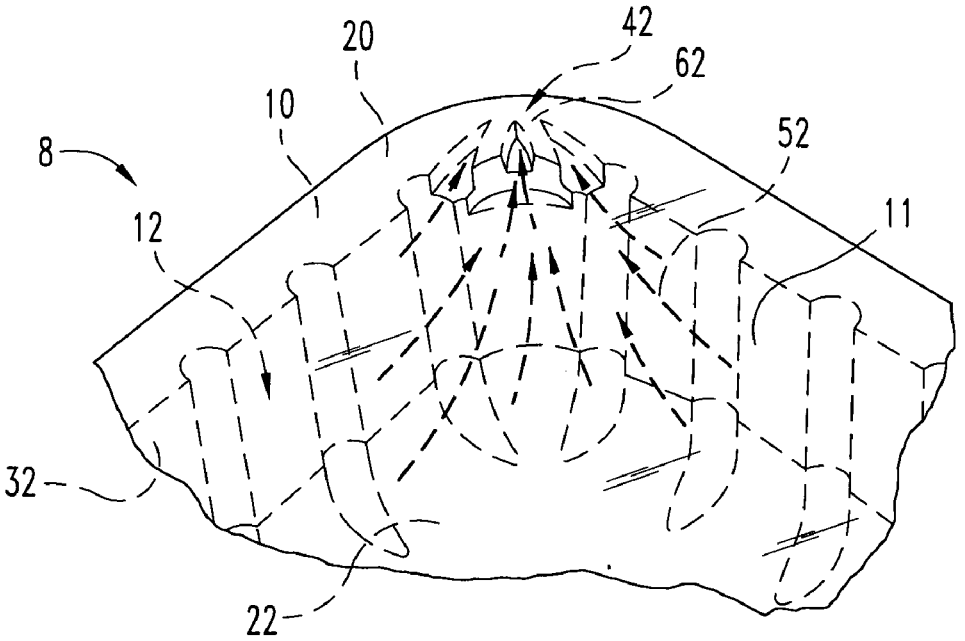
FIG. 2 is an enlarged partial perspective view of the microwave cooking device of FIG. 1, illustrating the movement of steam into the vents defined by the steam guide and steam horns of the venting configuration.
Figure 3:
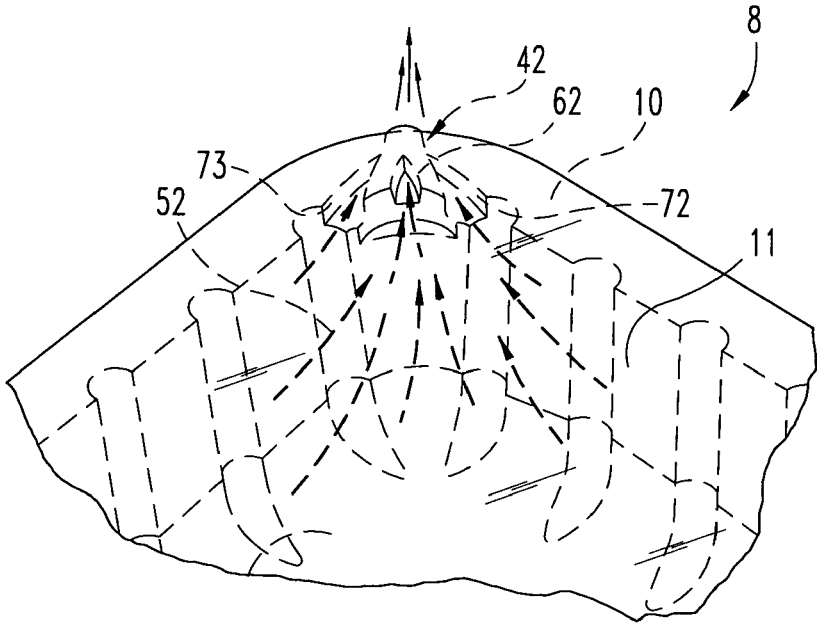
FIG. 3 is an enlarged partial perspective view of the microwave cooking device of FIG. 1, illustrating the concentrated pressure at the tip of the steam guide causing the seal to break at the predetermined location adjacent the venting configuration.

The present invention is a microwave cooking with an improved venting configuration. Referring to FIGS. 1 through 3, a cooking device 8 made in accordance with the present invention generally includes a container 10 for holding a food product, a seal for sealing the container 10, and a venting configuration 42 for controlled venting of the device 8.

The container 10 is preferably made of a food-grade plastic, such as polypropylene, and is transparent to radiant energy, such as energy from a microwave oven. The container 10 includes at least one compartment 12 for holding food product; however, the container of the present invention could have fewer or more compartments without departing from the spirit and scope of the present invention. The compartment 12 has a bottom surface 22 with a side wall 32 extending therefrom and terminating at an upper surface 20 defining the top of the device 8, an upper surface 20 that is substantially parallel to the bottom surface 22 of the compartment 12. The side wall 32 of the compartment 12 helps define the self-contained steam cooking environment of the compartment 12. To facilitate steam cooking of the food product, the compartment 12 is sealed and is equipped with a venting configuration 42 such that its volume remains constant until the pressure from the steam increases to a point that it causes the seal to break, as is further described below.

In the embodiment of the device depicted in FIGS. 1 through 3, the seal is created between the container 10 and a separate covering 11. The covering 11 is a film, which is sealed to the container 10 using, for example, heat or a food-grade adhesive. Of course, other coverings could be used without departing from the spirit and scope of the present invention; for example, a snap-on lid or a vacuum-sealed covering could be used to create the seal and to fix the volume enclosed by the container 10.

The venting configuration 42 of the present invention is designed to allow for controlled venting, specifically urging the seal to be broken at a predetermined location adjacent the venting configuration 42. The venting configuration 42 thus comprises at least one steam guide 62 and an associated pair of steam horns 72, 73.

The steam guide 62 is a substantially V-shaped central vent in the seal created by a cut-out in the upper surface 20 of the container 10, and having a tip of the "V" ending before the outer edge of the seal. The steam guide 62 is in fluid communication with the volume enclosed within the container. As shown in FIG. 1, although it is not required, the volume of the steam guide 62 can be increased by forming a substantially V-shaped indentation along the upper surface 20 of the container 10, such that the steam guide 62 has a depth that is greater than the nominal thickness of the upper surface 20 of the container 10. Because the surface area of the seal is reduced at the tip of the steam guide 62, there exists a weakened portion in the seal at that location, the significance of which will be discussed below. Although not necessary for efficient and controlled venting, a steam guide channel 82 may be disposed below and in fluid communication with the steam guide 62 to direct steam into the steam guide 62, the significance of which will also be discussed below.

The steam horns 72, 73 are positioned on either side of the steam guide 62. Each steam horn 72, 73 defines a side vent in the seal, again created by a cut-out in the upper surface 20 of the container 10 and ending before the outer edge of the seal. The steam horns 72, 73 are in fluid communication with the volume enclosed within the container. As shown in FIG. 1, although it is not required, the volumes of the steam horns 72, 73 can be increased by forming indentations along the upper surface 20 of the container 10, such that the steam horns 72, 73 each have a depth that is greater than the nominal thickness of the upper surface 20 of the container 10. Furthermore, it is preferred that each steam horn 72, 73 have a curved shape that is angled toward the tip of the steam guide 62. Because the surface area of the seal, which was first reduced at the tip of the steam guide 62, is further reduced by the incorporation of steam horns 72, 73, the seal is weakened further at this location, the significance of which will be discussed below. Although not necessary for efficient and controlled venting, a vertically oriented steam horn channel 86, 87 may be defined by the side wall 32 and disposed below and in fluid communication with each steam horn 72, 73 to direct steam into each steam horn 72, 73, the significance of which also will be discussed below.

The manner in which the device of the present invention operates will now be described with reference to FIGS. 2 and 3. Because the volume enclosed by the compartment 12 remains substantially constant until venting occurs, as steam is generated from the moisture of the food product during heating, pressure builds within the compartment 12. The heightened pressure resulting from the presence of the trapped steam causes the temperature within the compartment 12 to increase above a temperature able to be achieved at ambient pressures. As the pressure continues to build, the steam guide 62 directs the steam and pressure to its tip, as illustrated by the arrows 52 shown in FIGS. 2 and 3. Likewise, the steam horns 72, 73, which are angled inward toward the tip of the steam guide 62, direct the steam and pressure toward the tip of the steam guide 62.

Thus, the pressure is heavily concentrated at the weakened portion of the seal, i.e., the convergence of the tips of the steam guide 62 and associated steam horns 72, 73, causing the seal to break at this predetermined location, as shown in FIG. 3.

Because different foods have different textures and moisture contents, the same pressure is not ideal for cooking all types of foods. The amount of pressure that can be achieved within the container 10 can be controlled, to an extent, by varying the degree of adhesive power between the container 10 and the covering 11—the greater the adhesive power, the greater the pressure that must achieved to accomplish venting. Additionally, the venting configuration 42 could be customized such that the pressure achieved in the associated compartment 12 is optimal for the type of food product contained therein. In this regard, the venting configuration 42 can be customized in several different ways. For example, the angle of the pair of the steam horns 72, 73 may be varied such that they terminate at points of various distances from the tip of the associated steam guide 62, thus allowing the concentration of pressure to be directed over various widths along the seal. Therefore, if the distances between the tip of that steam guide 42 and the tips of the associated steam horns 72, 73 were increased, a greater portion of the seal would be broken. Likewise, the number of steam guides or steam horns in a particular compartment could be altered to vary the width of pressure concentration.

Figure 5:
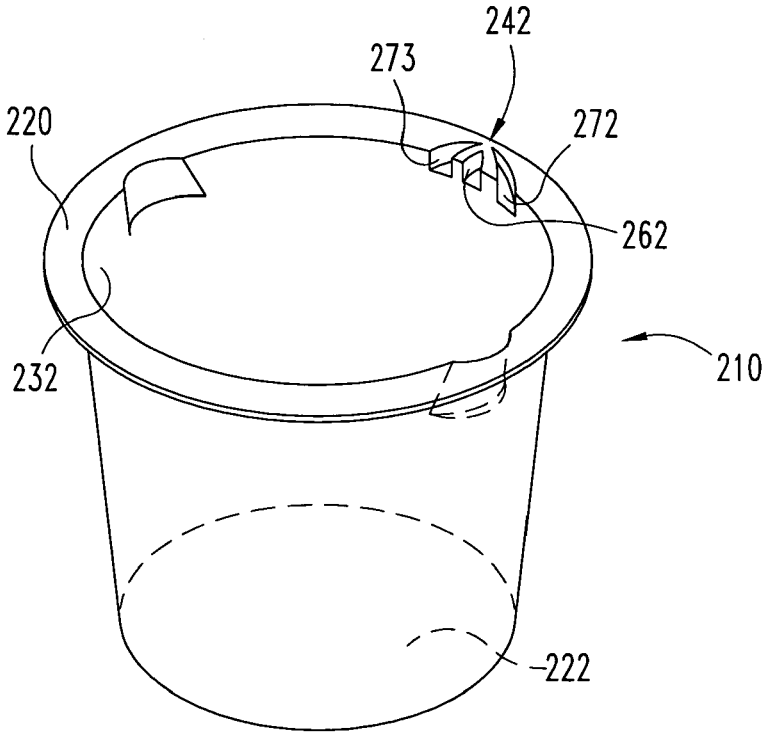
FIG. 5 is a perspective view of a container of an another alternate microwave cooking device made in accordance with the present invention.
Figure 4:
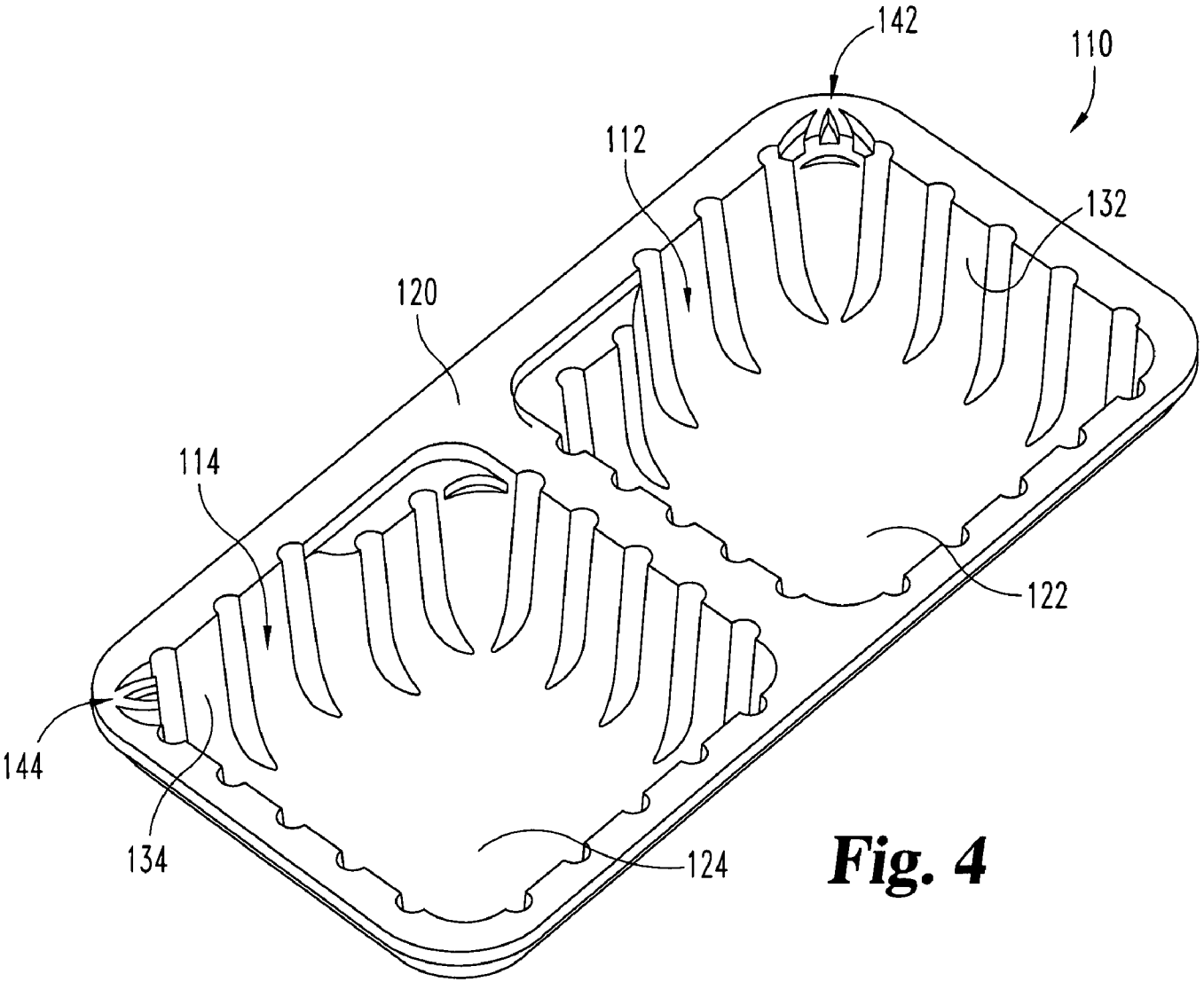
FIG. 4 is a perspective view of the container of an alternate microwave cooking device made in accordance with the present invention.
Figure 6:
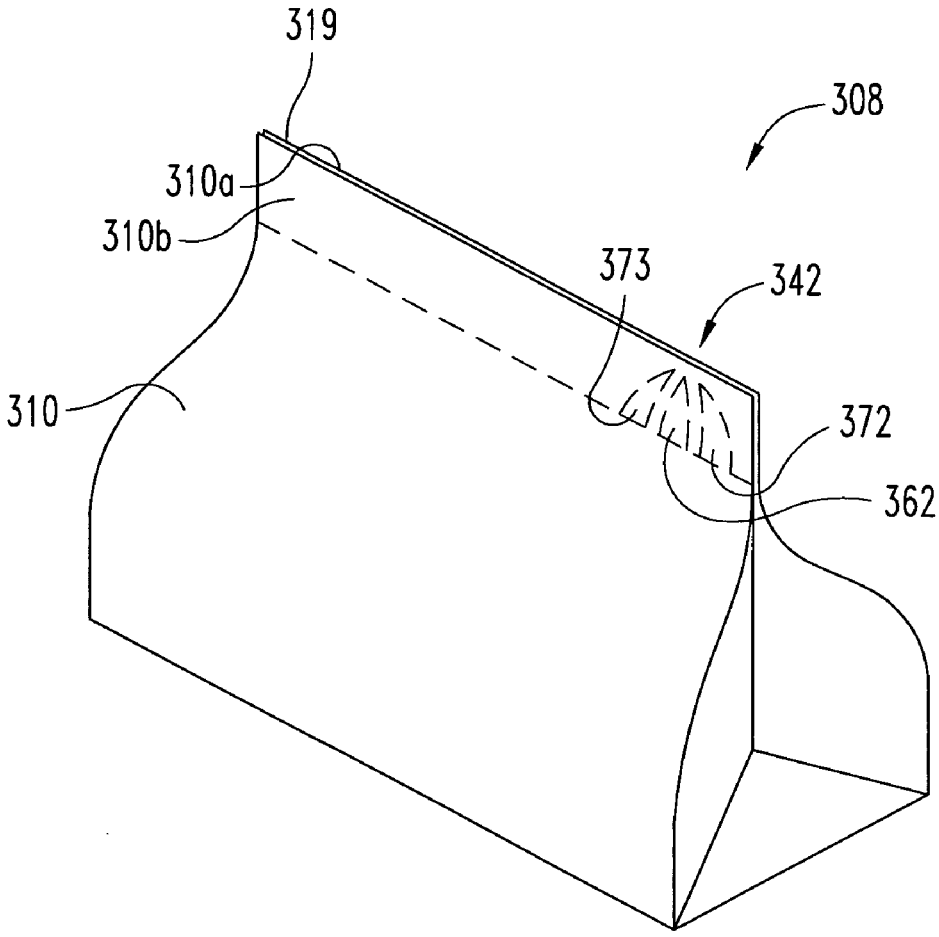
FIG. 6 is a perspective view of yet another alternate microwave cooking device made in accordance with the present invention.

Before turning to a description of the alternate embodiments depicted in FIGS. 4 through 6, it should be noted that the device of the present invention may take an number of forms as long as it includes (1) a container for holding food product, (2) a seal for sealing the container to enclose a substantially fixed volume therein, and (3) a venting configuration, the venting configuration having a structure that defines at least one guide and a pair of associated steam horns, the guide and steam horns each creating vents in the seal which are in fluid communication with the interior of the container and create a weakened portion in the seal at a predetermined location.

For example, FIG. 4 depicts an alternate embodiment of the present invention. The container 110 depicted in FIG. 4 includes two separate compartments 112, 114 for holding food product. The compartments 112, 114, of the container 110 each have a bottom surface 122, 124 with a respective side wall 132, 134 extending therefrom and terminating at a common upper surface 120 defining the top of the container 110. The side wall 132, 134 of each compartment 112, 114 serves as a divider to keep ingredients from mixing and to help define the self-contained steam cooking environments of each compartment 112, 114. To facilitate steam cooking of the food product, each individual compartment 112, 114 is sealed, the seal being created between a covering (not shown) and the upper surface 120 of the container 110, and is equipped with a venting configuration 142, 144 such that its volume remains constant until the pressure from the steam increases to a point that it causes the seal to break.

As mentioned above, because different foods have different textures and moisture contents, the same pressure is not ideal for cooking all types of foods. In a multi-compartment microwave cooking device, such as the embodiment depicted in FIG. 4, it would be difficult and cumbersome to create compartments having coverings with different adhesive powers. However, each venting configuration could be customized, as described above, such that the pressure achieved in the associated compartment is optimal for the type of food product contained therein. In this manner, each compartment 112, 114 in a single device 108 can achieve different pressures and cook contained food product at those pressure for varying amounts of time.

An example of another alternate embodiment of the present invention is depicted in FIG. 5. The container 210 has a substantially circular bottom surface 222 with a circumferential side wall 232 extending therefrom and terminating at a upper surface 220 defining the top of the container 210, the upper surface 220 being substantially parallel to the bottom surface 222 of the container 210. The substantially cylindrical shape of the container 210 makes if convenient for such food products as soups or warm beverages. Like the embodiments of the present invention described above, the seal (not shown) is created between the container 210 and a separate covering (not shown). Also like the embodiments of the invention described above, the volumes of the steam guide 262 and steam horns 272, 273 of in the venting configuration 242 are increased by forming indentations along the upper surface 220 of the container 210. These indentations, in addition to serving to facilitate controlled venting, may serve as a drinking port for consuming a prepared food product.

An example of another alternate embodiment of the present invention is depicted in FIG. 6. In the device 308 depicted in FIG. 6, the container 310 is a substantially flexible cooking bag having a terminal edge 319 defining an opening for receiving a food product. Quite distinctly from the embodiments described above, the seal is actually created between two portions 310*a*, 310*b* of the container 310 itself, the portions 310*a*, 310*b* preferably falling just below the terminal edge 319 of the container 310. The seal is created using, for example, heat or a food grade adhesive. The venting configuration 342 has a structure defining the steam guide 362 and the steam horns 372, 373, the guide 362 and horns 372, 373 each extending across the seal, ending before the outer edge of the seal, thereby creating vents in the seal which are in fluid communication with the interior of the container 310 and creating a weakened portion in the seal adjacent the venting configuration 342.

It will be obvious to those skilled in the art that other modifications may be made to the invention described herein without departing from the spirit and scope of the present invention.

The invention claimed is:

1. In a microwave cooking device, including a container for holding a food product and a seal for sealing said container to enclose a substantially fixed volume therein, the improvement comprising:

at least one venting configuration, including (a) at least one steam guide defining a central vent in the seal with a tip ending before an outer edge of the seal, the central vent weakening a portion of the seal adjacent the tip of said at least one steam guide and being in fluid communication with the volume enclosed within said container to allow movement of steam from said container into said at least one steam guide, and (b) at least one steam horn associated with and positioned near said at least one steam guide, the at least one steam horn defining a side vent in the seal and ending before the outer edge of the seal, the side vent further weakening the portion of the seal adjacent the tip of said at least one steam guide and being in fluid communication with the volume enclosed within said container to allow movement of steam from said container into said at least one steam horn, such that, when said container is heated, steam and pressure are preferentially directed towards the tip of said at least one steam guide, causing pressure to be concentrated at the weakened portion of the seal, resulting in the seal being preferentially broken adjacent the tip of said at least one steam guide.

2. The microwave cooking device as recited in claim 1, wherein the seal is created between two portions of said container.

3. The microwave cooking device as recited in claim 1, and further comprising a covering, wherein the seal is created between said container and said covering.

4. The microwave cooking device as recited in claim 3, wherein said covering is selected from the group consisting of: a film, a snap-on lid, and a vacuum-sealed covering.

5. The microwave cooking device as recited in claim 1, wherein said at least one steam horn is angled toward the tip of said at least one steam guide.

6. The microwave cooking device as recited in claim 1, wherein the volume of said at least one steam guide is increased by forming an indentation along an upper surface of said container.

7. The microwave cooking device as recited in claim 6, and further comprising a steam guide channel disposed below and in fluid communication with said at least one steam guide.

8. The microwave cooking device as recited in claim 6, wherein the volume of said at least one steam horn is also increased by forming indentations along the upper surface of said container.

9. The microwave cooking device as recited in claim 8, and further comprising a steam horn channel disposed below and in fluid communication with said at least one steam horn.

10. A method for packaging food, comprising the steps of:

providing a container for holding a food product;

placing one or more food products in said container;

sealing said container with a seal to enclose a substantially fixed volume therein; and providing said container with at least one venting configuration, having:

at least one steam guide defining a central vent in the seal with a tip ending before an outer edge of the seal, the central vent weakening a portion of the seal adjacent the tip of said at least one steam guide and being in fluid communication with the volume enclosed within said container to allow movement of steam from said container into said at least one steam guide; and at least one steam horn associated with and positioned near said at least one steam guide, the at least one steam horn defining a side vent in the seal and ending before the outer edge of the seal, the side vent further weakening the portion of the seal adjacent the tip of said at least one steam guide and being in fluid communication with the volume enclosed within said container to allow movement of steam from said container into the at least one steam horn, such that, when said container is heated, steam and pressure are preferentially directed towards the tip of said at least one steam guide, causing pressure to be concentrated at the weakened portion of the seal, resulting in the seal being preferentially broken adjacent the tip of said at least one steam guide.

11. The method for packaging food as recited in claim 10, wherein said at least one steam horn is angled toward the tip of said at least one steam guide.

12. The method for packaging food as recited in claim 10, wherein the volume of said at least one steam guide is increased by forming an indentation along an upper surface of said container.

13. The method for packaging food as recited in claim 12, wherein the volume of said at least one steam horn is increased by forming indentations along the upper surface of said container.

* * * * *